US006619477B2

(12) United States Patent
Takahashi

(10) Patent No.: US 6,619,477 B2
(45) Date of Patent: Sep. 16, 2003

(54) PALLET AND TRANSPORTATION CONTAINER

(76) Inventor: Mitsuo Takahashi, Sentosutokumanshon 201, 1-35-11, Nishimizue, Edogawa-ku, Tokyo (JP)

( * ) Notice: Subject to any disclaimer, the term of this patent is extended or adjusted under 35 U.S.C. 154(b) by 145 days.

(21) Appl. No.: 09/881,842

(22) Filed: Jun. 18, 2001

(65) Prior Publication Data

US 2002/0060163 A1 May 23, 2002

(30) Foreign Application Priority Data

Nov. 20, 2000 (JP) ..... 2000-353540
Jun. 1, 2001 (JP) ..... 2001-166343

(51) Int. Cl.[7] ..... B65D 19/00

(52) U.S. Cl. ..... 206/386; 217/43 A; 206/599; 220/1.5; 229/199.1

(58) Field of Search ..... 206/386, 599, 206/600; 108/56.1, 56.3, 156; 217/43 A, 43 R, 36, 65; 220/1.5, 4.28, 4.33; 229/199.1

(56) References Cited

U.S. PATENT DOCUMENTS 2,442,651 A * 6/1948 Johnson ..... 229/199.1
5,109,986 A * 5/1992 Pruitt, Jr. ..... 206/600
5,269,455 A * 12/1993 Grigsby et al. ..... 217/43 A
5,381,915 A * 1/1995 Yardley ..... 206/600
5,669,507 A * 9/1997 Pruitt, Jr. ..... 206/599
6,076,690 A * 6/2000 Hemmerly ..... 217/43 R
6,250,050 B1 * 6/2001 Grigsby, Sr. ..... 206/386

FOREIGN PATENT DOCUMENTS

| | | |
|---|---|---|
| JP | 63-62334 | 4/1988 |
| JP | 63-62335 | 4/1988 |
| JP | 63-105636 | 7/1988 |
| JP | 1-141223 | 9/1989 |
| JP | 1-254548 | 10/1989 |
| JP | 4-48132 | 4/1992 |
| JP | 5-278784 | 10/1993 |
| JP | 7-247624 | 9/1995 |
| JP | 8-4115 | 1/1996 |
| JP | 8-113239 | 5/1996 |
| JP | 11-50582 | 2/1999 |
| JP | 11-198934 | 7/1999 |

* cited by examiner

*Primary Examiner*—Luan K. Bui
(74) *Attorney, Agent, or Firm*—Armstrong, Westerman & Hattori, LLP

(57) ABSTRACT

A transportation container comprising a plywood mount panel, a metal pipe leg disposed under the mount panel, vertical-panel support members each mounted on the upper face of the mount panel and disposed along the sides of the mount panel, solid hardboard vertical panels each having a lower edge mounted onto a mounting face in the outer side face of the vertical-panel support member by means of nailing; a metal pipe beam disposed along the upper side of the inner face of the vertical panel; a substantially rectangular, solid hardboard top panel supportedly positioned on the upper end face of the beam; and a metal pipe column disposed on the inside of butt corners formed by adjacent vertical panels to extend vertically.

14 Claims, 8 Drawing Sheets

PALLET AND TRANSPORTATION CONTAINER

FIELD OF THE INVENTION

The present invention relates to a pallet and transportation container for use in transporting cargo.

BACKGROUND OF THE INVENTION

Conventional pallets and transportation containers have a general structure made of metallic materials, plastic materials, corrugated cardboards, woods or the like. In usual applications, they have been typically made of woods. Metal products involve undesirably increased weight and inferior operation performance. In addition, these metal products leads to increased transport cost, particularly in dealing with air cargo. In plastic products, it is necessary to prepare an expensive molding die for fabricating such pallets or transporting containers. This increases their manufacturing cost, and imposes a restriction on providing various sizes of pallets or transporting containers, resulting in restricted application. In products made of corrugated cardboards, the corrugated cardboards inevitably include a space therewithin. This space undesirably allows moisture to flow in therethrough, and provides low strength of the products and deteriorated operation performance of nailing, screw clamping or bolting. Thus, it is not easy to assemble the pallets or transportation containers made of corrugated cardboards by means of nailing, screw clamping or bolting.

On the other hand, for cargos transporting from United States, Japan and other countries to China, a duty of undergoing plant quarantine and a ban on using wooden materials for packing may be put in force for preventing an invasion of pest insects. In the event of using transportation containers made of woods, it is require to subject to appropriate heat treatments for pest control and to have an official certification as to a proof of such heat treatments. Thus, a lot of cost, time and labor will be imposed to take the heat treatments and acquiring the certification. Particularly, in view of time scale, it will be difficult to adequately handle transportations with urgency such as air cargos. However, plywood (veneer plywood or veneered wood) has no requirement for the above heat treatments and the certification as to a proof of such heat treatments because the plywood never includes pest insects therewithin and thereby has no necessity of pest control.

Further, it has heretofore been necessary to take a long time for an assembling or disassembling operation of the transportation container, and it has often been the case that the transportation container was damaged during opening the package.

SUMMARY OF THE INVENTION

In view of the above problems, it is therefore an object of the present invention to provide a pallet and a transportation container capable of eliminating the need of heat treatments, readily dealing with various sizes of cargos, and allowing an easy assembling operation.

In order to achieve this object, according to a first aspect of the present invention, there is provided a pallet comprising a mount panel made of plywood or hardboard, and a metal pipe leg having a substantially rectangular profile and for providing a space under the mount panel to allow a fork of a forklift truck to be inserted therein. The metal pipe leg has a substantially horizontal axis and is nailed to the mount panel by a screw-type nail.

According to a second aspect of the present invention, there is provided a pallet comprising a substantially rectangular mount panel made of plywood or hardboard, a metal pipe leg having a substantially rectangular profile and for providing a space under the mount panel to allow a fork of a forklift truck to be inserted therein, and a resin material filled in the interior space of the leg. The leg has a substantially horizontal axis and is nailed to the mount panel by a screw-type nail. Further, the front end of the nail is struck into the resin material.

In the above pallet according to the present invention, the mount panel is made of plywood or hardboard, and the leg is made of metal. Thus, differently from conventional wooden pallets, the pallet of the present invention has no need of pest control, and thereby no requirements of heat treatments, the certification as to a proof of such heat treatments and the like. The mount panel made of plywood or hardboard may provide a sufficient strength. Plywood or hardboard may be readily cutoff to fabricate various sizes of pallets, and may provide lower manufacturing cost than that in aluminum. Differently from aluminum products, the mount panel made of plywood or hardboard may be readily assembled with nails, and its weight reduction may be more effectively facilitated than metal panels such as steel panels. In addition, the leg composed of a metal pipe may be readily fabricated by cutting off a long metal pipe and fabricated in various sizes of pallets. Such leg may be more reliably assembled with high strength as compared to plastic or paper products, and may readily assure an adequate height required as a distance retainer. Further, using screw-type nails may prevent the nails from coming off despite of forming the leg from a metal pipe. Thus, various sizes of pallet may be readily fabricate on site of an operation for loading a cargo, and may eliminate the requirements, such as heat treatments, the certification as to a proof of the heat treatments to cope with various cargos. This is advantageous particularly for air cargo.

As described above, when the metal pipe leg is nailed, the front end of the nail can undesirably project into the interior space of the metal pipe. In the pallet of the present invention, the interior space is filled with the leg resin material. This may prevent the front end of the nail from accidentally coming into contact with an object. Further, the front end of the nail is struck into the leg resin material to prevent the leg resin material from getting out of the leg.

According to a third aspect of the present invention, there is provided a transportation container comprising: a substantially rectangular mount panel made of plywood or hardboard; a metal pipe leg, having a substantially rectangular profile, disposed under the mount panel, and including light and left sections each along corresponding one of the right and left sides of the mount panel with placing each side face of the light and left sections on substantially the same plane as that of corresponding one of the end faces of the mount panel; front and rear vertical-panel support members, each of which is mounted on the upper face of the mount panel and is disposed along corresponding one of front and rear sides of the mount panel with keeping a given distance from corresponding one of the end faces of the mount panel; right and left vertical-panel support members, each of which is mounted on the upper face of the mount panel and is disposed along corresponding one of the right and left sides of the mount panel with placing each side face of the right and left vertical-panel support members on substantially the same plane as that of corresponding one of the end faces of the mount panel; front and rear vertical panels, each of which is made of plywood or solid hardboard and has a lower edge mounted onto a mounting face in the outer side face of corresponding one of the front and rear vertical-panel support members by means of either one of nailing, screw clamping and bolting from outside; right and left vertical panels, each of which is made of plywood or solid hardboard and has a lower edge mounted onto the leg from outside by means of either one of nailing, screw clamping and bolting and mounted onto a mounting face in the outer side face of corresponding one of the right and left vertical-panel support members by means of either one of nailing, screw clamping and bolting from outside; a beam made of a metal pipe or paper pipe and disposed along the upper side of each inner face of the vertical panels; a substantially rectangular top panel made of plywood or solid hardboard and supportedly positioned on the upper end face of the beam; and a column made of a metal pipe or paper pipe and disposed on the inside of each butt corner formed by adjacent vertical panels to extend vertically, wherein the mount panel, the front, rear, right and left vertical panels and the top panel define an interior space serving as a cargo space, the vertical-panel support members being made of either one of a metal pipe, paper pipe and plywood, and the column being mounted onto each of the vertical panels from the outside of the vertical panels by means of either one of nailing, screw clamping and bolting without nailing, screw clamping or bolting to the vertical-panel support members and the beam.

According to a fourth aspect of the present invention, there is provided a transportation container comprising: a substantially rectangular mount panel made of plywood or hardboard; a metal pipe leg, having a substantially rectangular profile, disposed under the mount panel, and including light and left sections each along corresponding one of the right and left sides of the mount panel; front, rear, right and left vertical-panel support members, each of which is mounted on the upper face of the mount panel and is disposed along a corresponding side of the mount panel; front, rear, right and left vertical panels, each of which is made of plywood or solid hardboard and is mounted onto a mounting face in a corresponding outer side face of the support members by means of either one of nailing, screw clamping or bolting from outside; a beam made of a metal pipe or paper pipe and disposed along the upper side of each inner face of the vertical panels; a substantially rectangular top panel made of plywood or solid hardboard and supportedly positioned on the upper end face of the beam; a column made of a metal pipe or paper pipe, disposed on the inside of each butt corner formed by adjacent vertical panels and extending vertically; a vertical corner member made of solid hardboard, disposed on the outside of each butt corner formed by adjacent vertical panels and extending vertically so as to cover the outer face of both edges of the adjacent vertical panels; a horizontal corner member made of solid hardboard, disposed on the outside of each butt corner formed by the top panel and the vertical panels and extending horizontally so as to cover the outer face of both edges of the top panel and the vertical panels, wherein the mount panel, the front, rear, right and left vertical panels and the top panel define an interior space serving as a cargo space, the vertical-panel support members being made of either one of a metal pipe, paper pipe and plywood, the column being mounted onto the vertical panel from the outside of the vertical corner member by means of either one of nailing, screw clamping and bolting without nailing, screw clamping or bolting to the vertical-panel support member and the beam, and the vertical panel and the top panel being mounted onto the beam from the outside of the horizontal corner member by means of either one of nailing, screw clamping and bolting.

According to a fifth aspect of the present invention, there is provided a transportation container comprising: a substantially rectangular mount panel made of plywood or hardboard; a metal pipe leg, having a substantially rectangular profile, disposed under the mount panel, and including light and left sections each along corresponding one of the right and left sides of the mount panel; front, rear, right and left vertical-panel support members, each of which is mounted on the upper face of the mount panel and is disposed along a corresponding side of the mount panel; front, rear, right and left vertical panel, each of which is made of plywood or solid hardboard and is nailed to a mounting face in a corresponding outer side face of the support member from outside; a beam made of a metal pipe or paper pipe, nailed to the inner face of the vertical panel from the outside of the vertical panels, and disposed along each upper side of the vertical panels; a substantially rectangular top panel made of plywood or solid hardboard, and supportedly positioned on the upper section of the beam and nailed to the beam from above; a column made of a metal pipe or paper pipe, disposed on each butt corner formed by adjacent vertical panels and extending vertically, wherein the mount panel, the front, rear, right and left vertical panels and the top panel define an interior space serving as a cargo space, all of the mount panel, vertical panels, top panel, leg, vertical-panel support members, beam and column being assembled and fixed by means of nailing with screw-type nails, the vertical-panel support members being made of either one of a metal pipe, paper pipe and plywood, the column being nailed from the outside of the vertical panel without nailing to the vertical-panel support member and the beam, and a part of the screw-type nails hammered to at least one panel of the vertical panels and the top panel having a head formed in hexagon for fitting to wrenches.

In the transportation containers according to the present invention, each of the vertical panels may be formed by laminating a plurality of solid hardboards including an outer hardboard and inner hard board. The outer hardboard may have side edges each protruding outward from a corresponding side edge of the inner hardboard, and each side edge of the inner hardboard in one of the vertical panels may be opposed to the edge of the inner face of either one of the hardboards in another vertical panel.

In this vertical panel composed of the plurality of solid hardboards superposed each other, the outer hardboard may include an upper edge having a substantially the same height as the upper edge of the inner hardboard and an lower edge located higher than the lower edge of the inner hardboard, and the upper edge of the vertical panel is covered by the top panel.

In the vertical panel composed of the plurality of solid hardboards superposed each other, the outer hardboard may includes; an upper edge located lower than the upper edge of the inner hardboard; and an lower edge located higher than the lower edge of the inner hardboard, and the upper edge of the vertical panel may be covered by the top panel. Further, in the vertical panel composed of the plurality of solid hardboards superposed each other, the outer hardboard may include; an upper edge located lower than the upper edge of the inner hardboard; and an lower edge vertical-panel support members and the leg, reliable fastness may be provided with high strength. Further, nailing the column from the outside of the vertical panels prevents the head of nail from deteriorating the containability for cargos. Disposing the front and rear vertical-panel support members for mounting the front and rear vertical panels with keeping a given distance from the end face of the mount panel allows the lower edge of the front and rear vertical panels to be supported by the mount panel. Furthermore, since the column, vertical-panel support members and beam are nailed to the vertical panels without being directly connected with each other by means of nailing, screw clamping or bolting, these components may be readily separated when the vertical panels are detached.

In one aspect of the present invention, the corners of the transportation container are covered by the corner member. This allows the corners to be desirably protected and may prevent water or the like from intruding inside as less as possible.

In one aspect of the present invention, all of the mount panel, vertical panels, top panel, leg, vertical-panel support members, beam and column are assembled and fixed by means of nailing with screw-type nails, the vertical-panel support members being made of either one of a metal pipe, paper pipe and plywood, the column being nailed to each of the vertical panels from the outside of the vertical panel without nailing to the vertical-panel support member and the beam, and a part of the screw-type nails hammered to at least one panel of the vertical panels and the top panel has a head formed in hexagon for fitting to wrenches. In this case, the assembling operation is completed by hammering the screw-type nails. This may provide a speedy operation, and may more effectively located higher than the lower edge of the inner hardboard, and the upper edge may be covered by the top panel.

Further, the transportation containers according to the present invention may further include: a metal pipe center leg having a substantially rectangular profile and disposed between and substantially in parallel with the right and left leg sections of the leg; a partition member disposed longitudinally on the mount panel, located between the right and left vertical-panel support members, positioned substantially right above the center leg, and made of either one of a metal pipe, paper pipe or plywood; an elastic resin material having a buffering function, and disposed between the partition member and the right vertical-panel support member and between the partition member and the left vertical-panel support member; a floor panel made of solid hardboard or plywood, covering over the elastic resin material, and having a central section and edge section supported by the partition member and the vertical-panel support members, respectively.

Additionally, in the pallets and the transportation containers according to the present invention may further include a connecting member, such as a bottom panel or supporting leg, made of a plywood or metal pipe and for connecting to different sections of the lower face of the leg.

According to the above transportation container of the present invention, the components of the transportation container are made of plywood, metal and solid hardboard. Thus, differently from conventional wooden transportation containers, the transportation container of the present invention has no need of pest control, and thereby no requirements of heat treatments, the certification as to a proof of such heat treatments and the like. By mounting the right and left vertical panels on both the prevent the nails from coming off, as compared to conventional nails. Further, the vertical panels are nailed with nails each having a head formed in hexagon for fitting to wrenches so that these nails may be readily pulled out during an operation for opening packages. Thus, the operation for opening packages may be completed quickly, and the damage of the vertical panel may be desirably reduced.

In one embodiment of the present invention, each of the vertical panels is formed by laminating a plurality of solid hardboards including an outer hardboard and inner hard board, the outer hardboard having side edges each protruding outward from a corresponding side edge of the inner hardboard, and each side edge of the inner hardboard in one of the vertical panels being opposed to the edge of the inner face of either one of the hardboards in another vertical panel section. In this case, the strength of the vertical panel may be enhanced by laminating the solid hardboards. In addition, since each side edge of the outer hardboard protrudes outward from a corresponding side edge of the inner hardboard, and each side edge of the inner hardboard in one of the vertical panels is opposed to the edge of the inner face of either one of the hardboards in another vertical panel section, it may be effectively avoided to incur damage by water intruding from outside.

In another embodiment of the present invention, the vertical panel is composed of the plurality of solid hardboards superposed each other, wherein the outer hardboard includes an upper edge having a substantially the same height as the upper edge of the inner hardboard and an lower edge located higher than the lower edge of the inner hardboard, and the upper edge of the vertical panel is covered by the top panel. If the upper edge of the outer hardboard protrudes outward from the upper edge of the outer hardboard, as with the side edges of the vertical panels, just intruding water is not discharged outside but intrudes inside as-is. In order to prevent this problem, the upper edge of the outer hardboard is arranged in a substantially the same height as the upper edge of the inner hardboard, and the upper edge of the vertical panel is covered by the top panel. Further, the lower edge of the outer hardboard is located higher than the lower edge of the inner hardboard. This may prevent objects from being caught on the lower edge of the outer hardboard.

In the vertical panel composed of the plurality of solid hardboards superposed each other, the outer hardboard includes an upper edge located lower than the upper edge of the inner hardboard and an lower edge located higher than the lower edge of the inner hardboard, and the upper edge of the vertical panel is covered by the top panel. This embodiment may desirably prevent water flowing along the end face of the top panel from intruding the inside of the transportation container through the upper end face of the vertical panels.

In another embodiment of the present invention, the transportation container includes the metal pipe center leg having a substantially rectangular profile. This center led is disposed between and substantially in parallel with the right and left leg sections of the leg disposed along the right and left sides of the mount panel, and disposed longitudinally on the mount panel and located between the right and left vertical-panel support members. Further, the partition member is positioned substantially right above the center leg, and is made of either one of a metal pipe, paper pipe or plywood. The transportation container further includes an elastic resin material having a buffering function and disposed between the partition member and the right vertical-panel support member and between the partition member and the left vertical-panel support member, and a floor panel made of solid hardboard or plywood and covering over the elastic resin material, the floor panel having a central section and edge section supported by the partition member and the vertical-panel support members, respectively. In this case, a baggage may be protected by the elastic resin material, and the partition member may prevent the elastic resin material to be deviated from the right position. Providing the floor panel on the resilient resin material may prevent exceeding sinking or unstability. Additionally, positioning the partition member right above the center leg may prevent the elastic resin material and mount panel from locally receiving excessive load.

Other features and advantages of the present invention will be apparent from the accompanying drawings and from the detailed description.

BRIEF DESCRIPTION OF THE DRAWINGS

FIG. 6 shows a screw-type nail, wherein

FIGS. 6(*a*) and (*b*) are a side view and an end view from the arrow b—b in FIG. 6(*a*), respectively, showing a screw-type nail having a hexagonal head, and FIGS. 6(*c*) and (*d*) are a side view and an end view from the arrow d—d in FIG. 6 (*c*), respectively, showing a screw-type nail having a circular head.

DESCRIPTION OF THE PREFERRED EMBODIMENT

Figure 1:
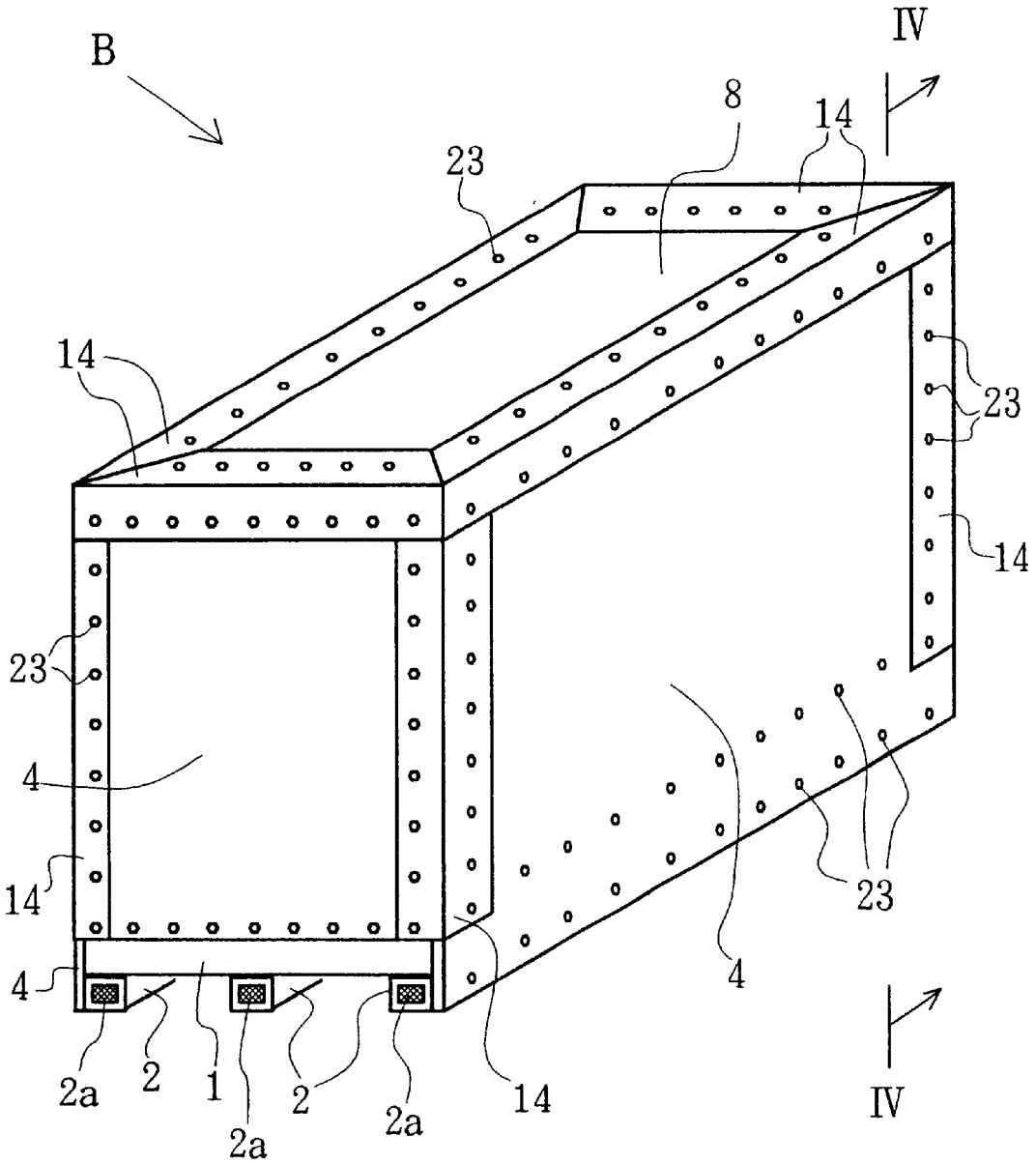
FIG. 1 is a perspective view of a transportation container according to the present invention.
Figure 2:
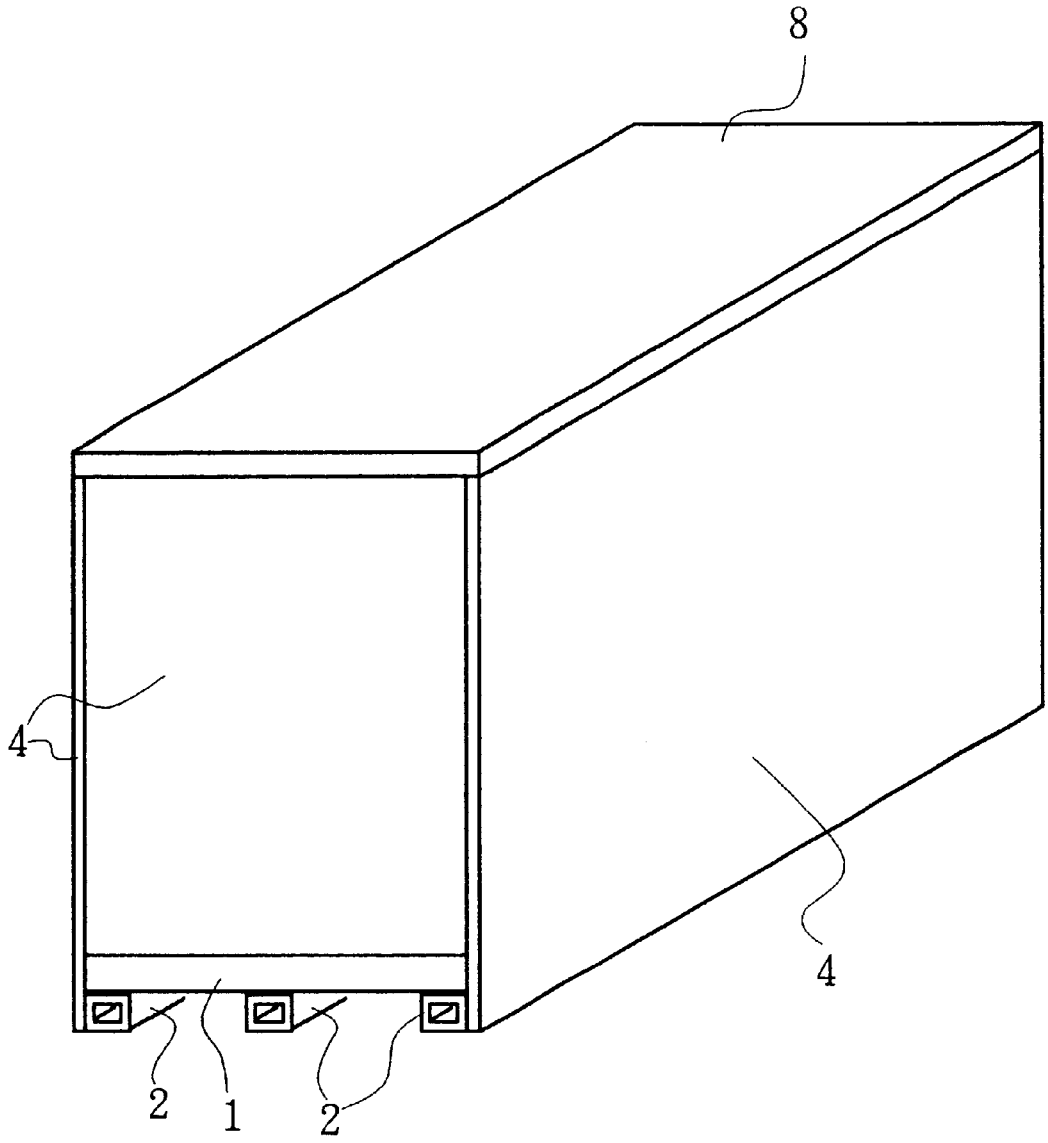
FIG. 2 is a perspective view of the transportation container of FIG. 1 in which nails and corner members are taken away.
Figure 3:
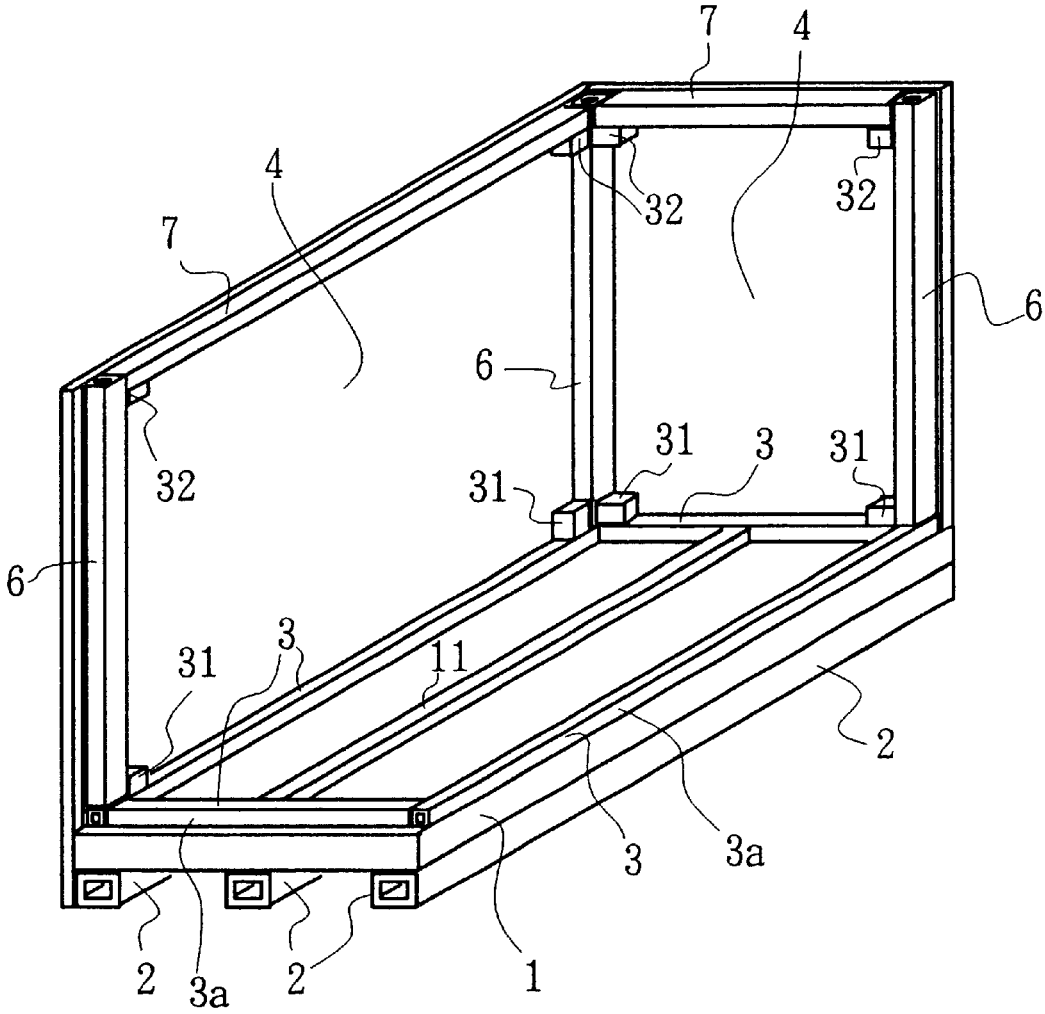
FIG. 3 is a perspective view of the transportation container of FIG. 1 in which a top panel, front vertical panel, right vertical panel, elastic resin material and floor panel are taken away.
Figure 4:
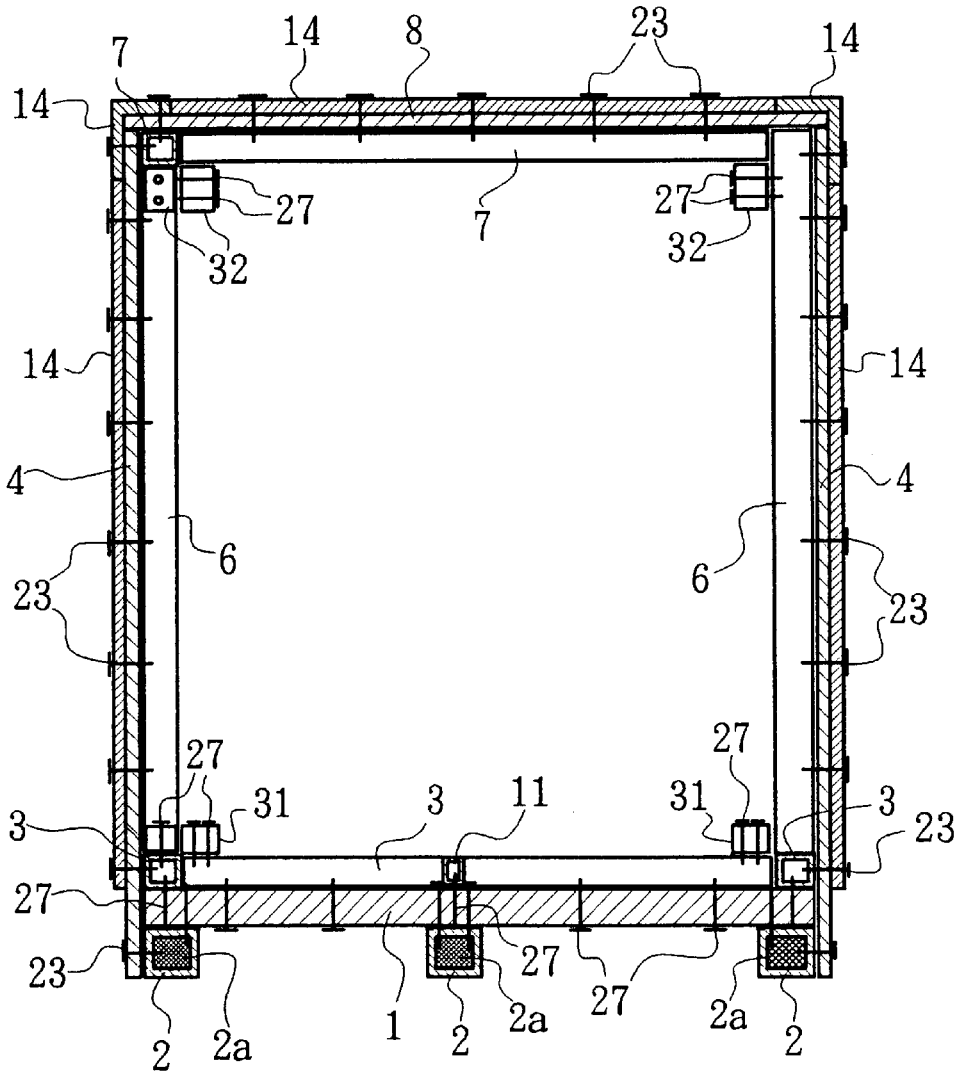
FIG. 4 is a sectional view of the transportation container taken along the line in FIG. 1.
Figure 5:
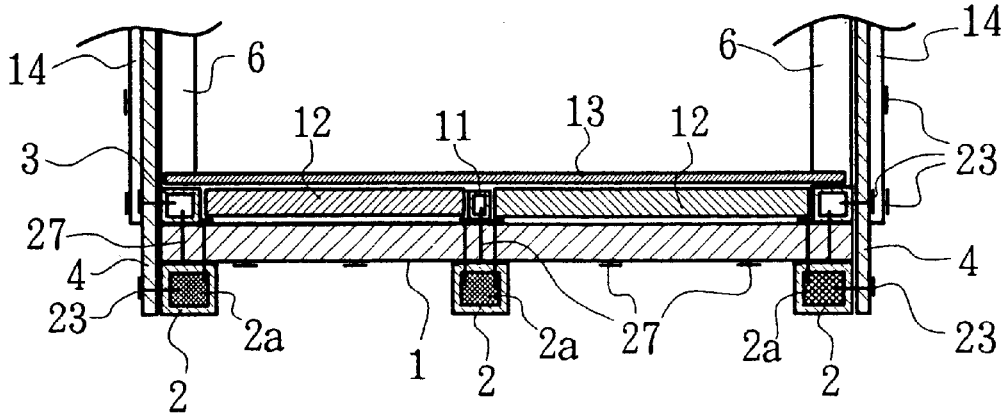
FIG. 5 is a sectional view of a lower part of a transportation container according to the present invention.

With reference to FIGS. 1 to 8, a pallet and transportation container according to one embodiment of the present invention will now be described. In these figures, a leg resin material is omitted In FIG. 2, and right sections of a beam, beam-support members, positioning members, elastic resin materials and floor panel are omitted in FIG. 4.

In FIGS. 1 to 6, a transportation container B is made of steel, solid hardboard or paperboard, resin material and plywood, that is, any conventional woods having the need of pest control are not used in this transportation container B. The solid hardboard including a fiberboard has an excellent strength and impermeability to water, and its thickness is typically about 2 to 5 mm. The transportation container B comprises a mount panel 1, a leg 2 disposed on the lower face of the mount panel 1, vertical-panel support members 3 disposed on the upper face of the mount panel 1, vertical panels 4 each having a lower edge which is mounted on corresponding one of the vertical-panel support members 3, a column 6 mounted on each of the vertical panels, a beam 7 mounted on each upper edge of the vertical panels 4, a top panel 8 mounted on the upper face of the beam, a partition member 11 located between the right and left sections of the vertical-panel support member 3, an elastic resin material 12 provided between the vertical-panel support member 3 and the partition member 11, a floor panel 13 covering over the elastic resin material, and a corner member 14 covering over each corner formed by the vertical panels and each corner formed by the vertical panels and the top panel. A substantially rectangular space surrounded by the mount panel 1, the front, rear, right and left vertical panel 4 and the top panel provides a cargo space.

Figure 6:
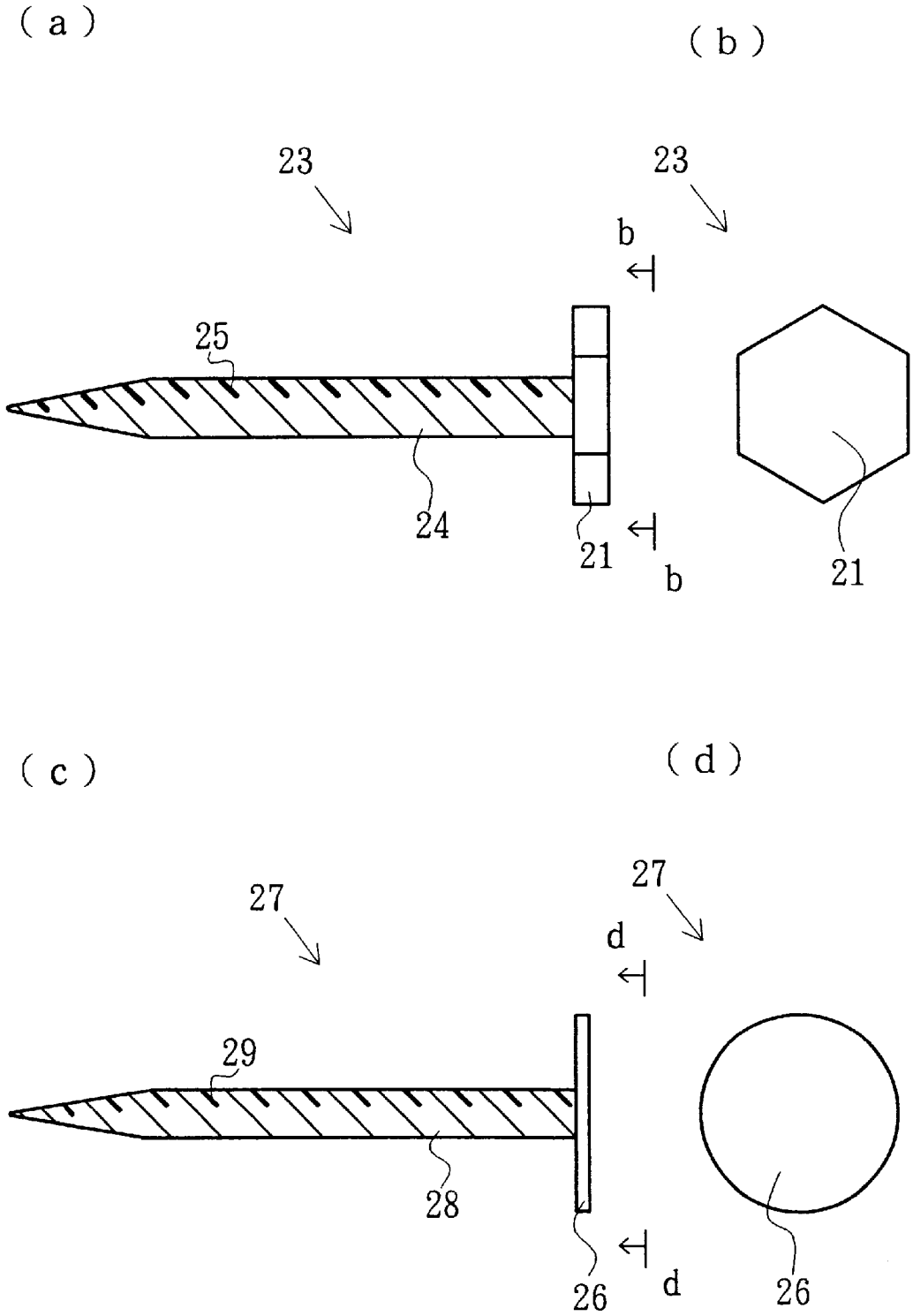

All of the above components are assembled and fixed by means of nailing with screw-type nails. While there are various kinds of screw-type nails, this embodiment employs a hexagonal head nail 23 having a hexagonal head 21 for fitting to wrenches, as shown in FIGS. 6(*a*) and (*b*), and a circular head nail 27 having a circular head 26 thinner than the head 21, as shown in FIGS. 6(*c*) and (*d*). Each rod 24, 28 of the hexagonal head nail 23 and circular head nail 27 has a sharp front end and a periphery formed with a thread 25, 26. A base section of each rod 24, 28 is integrally connected with the center section of the back face of each head 21, 26. In either of the hexagonal head nail 23 and circular head nail 27, the screw-type nails are struck using a hammer or the like for nailing. During disassembly, the hexagonal head nail 23 may be readily detached with a suitable wrench. While the circular head nail 27 is hardly detached, its thin head 26 is advantageous to reduce undesirable protrusion.

The mount panel 1 having an upper face for loading cargo or the like thereon is formed in a rectangular, such as square or oblong, flat panel made of plywood (veneer). On the lower face of the mount panel, the leg 2 includes right and left leg sections, each of which is disposed along corresponding one of the right and left sides of the mounting board 1, and a center leg section located between the right and left leg sections. These leg sections of the leg 2 are arranged substantially in parallel with each other, and are made of a steel pipe having a rectangular profile. One side face of each of right and left leg sections 2 is located on substantially the same plane as that of the end face of the mount panel 1. A substantially rectangular-parallelepiped, block-like leg resin material 2*a* is inserted into the inner space of the steel pipe of the leg 2 to fill up the inner space. The leg 2 is nailed to the mount panel 1 from above the mount panel by the circular head nails 2. The front ends of the circular head nails 27 are struck into each of the leg resin material 2*a* to prevent the leg resin materials from getting out of the leg 2. In this case, the leg resin materials 2*a* may prevent the front ends of the circular head nails 27 from undesirably coming into contact with some object. The outer periphery or upper face of the rectangular pipe of the leg 2 contacts the lower face the mount panel 1. The leg 2 provides a given distance between the mount panel 1 and a surface of a storage site, such as ground, for placing the transportation container thereon, and thereby a space for allowing the forks of forklift trucks to be inserted therein may be reliably provided between the mount panel 1 and the surface of the storage site. The upper and lower faces of the mount panel 1 and top panel 8 and the axis of the rectangular pipe of the leg 2 are arranged substantially in parallel to each other. Thus, if the transportation container is placed on a horizontal site, the upper and lower faces of the mount panel 1 and top panel 8 and the axis of the rectangular pipe of the leg 2 will be substantially horizontally positioned.

The vertical-panel support member 3 is composed of a rectangular steel pipe or plywood block formed in an elongated shape, and is mounted onto the mount panel 1 with the circular head nails 27. The vertical-panel support member 3 is disposed along each side (four sides) of the mount panel 1 with keeping a given distance from each end face of the mount panel 1 and placing one side face (mounting face 3*a*) of the vertical-panel support member on substantially the same plane as that of the end face of the mount panel. The vertical-panel support member 3 comprises four sections in the form of a rectangular frame as a whole, and the outer side face of the vertical-panel support member 3 serves as a mounting face 3*a* which is positioned substantially perpendicular to the upper face of the mount panel 1. A space in the rectangular frame formed by the vertical-panel support member 3 is parted right and left or in the lateral direction of the transportation container B by the partition member 11. The partition member 11 is positioned substantially right above the center leg 2. As with the vertical-panel support member 3, the partition member 11 is composed of a steel pipe or plywood block formed in an elongated shape having a rectangular profile, and is mounted onto the upper face of the mount panel 1 by the circular head nails 27. The upper face of the partition member 11 has substantially the same height as that of the upper face of the vertical-panel support member 3. The front edge of the partition member 11 substantially comes into contact with the front section of the vertical-panel support member 3 and the rear edge of the partition member 11 substantially comes into contact with the rear section of the vertical-panel support member 3. An elastic resin material 12 having a buffering function is provided between the partition member 11 and the right section of the vertical-panel support member 3 and between the partition member 11 and the left section of the vertical-panel support member 3 to fill up a space defined by the partition member 11 and the vertical-panel support member 3. Preferably, the elastic resin material 12 is formed to have a height slightly higher than those of the partition member 11 and the vertical-panel support member 3. The floor panel 13 covers over the elastic resin material 12 and the partition member 11. The floor panel 13 is made of plywood or solid hardboard. The edge section of the floor panel 13 extends to cover the upper face of each section of the vertical-panel support member 3. Thus, the floor panel 13 may be supported by the vertical-panel support member 3 and the partition member 11 to allow objects such as baggage to be placed on the floor panel 13.

The vertical panels 4 are made of solid hardboard. The right and left vertical panels 4 have a vertical height than those of the front and rear vertical panels. Specifically, each lower edge of the right and left vertical panels extends to the leg 2, whereas each lower edge of the front and rear vertical panels extends just to the front and rear sections of the vertical-panel support member 3. However, each upper edge of the vertical panels 4 is arranged in substantially the same height. Each of the right and left vertical panels 4 is nailed to the vertical-panel support member 3 and the leg 2 from outside with the hexagonal head nails 23. Thus, the right and left vertical panels 4 may be reliably fixed by mounting onto both of the vertical-panel support member 3 and the leg 2 by means of nailing. Each of the front and rear vertical panels 4 is nailed to the vertical-panel support member 3 from outside with the hexagonal head nails 23. Further, each lower end face of the front and rear vertical panels 4 comes close to or in contact with the mount panel 1 so that when a large load is imposed on the vertical panels 4 downward, such load may be supported by the mount panel 1. This may prevent the rod section 24 of the hexagonal head nail 23 nailed to the front and rear vertical panels 4 from suffering a large sharing force.

The column 6 is disposed on the inside of each butt corner to be formed by adjacent vertical panels. The column 6 is composed of a steel pipe having a rectangular profile. The column 6 extends vertically along the side section of each inner face of adjacent vertical panels 4. The lower edge of the column 6 is opposed to the upper face of a corresponding corner of the vertical-panel support member 3, and the upper edge of the column 6 extends substantially to corresponding upper edges of vertical panels 4. The outer face of each butt corner formed by adjacent vertical panels 4 is covered by a corner member 14 bent substantially at a right angle. This corner member 14 is made of solid hardboard. The adjacent vertical panels 4 are nailed to the outer side face of the column 6 from the outside of the vertically extending section of the corner member 14 with the hexagonal head nails 23. The beam 7 is disposed along the upper side of the upper edge of each inner face of the vertical panels 4, and is composed of a steel pipe having a rectangular profile. The beam 7 extends substantially horizontally, and each section of the beam 7 has edges each of which substantially comes into contact with the column 6. Each corner between the top panel 8 and the vertical panels 4 is covered by the horizontally extending section of the corner member 14 from outside, and the beam 7 is nailed to corresponding one of the vertical panels 4 from the outside of the corner member 14 with the hexagonal head nails 23.

The top panel 8 is made of solid hardboard. The top panel 8 is disposed above the beam 7 to cover over each upper end face of the vertical panels 4, and is nailed to the beam 7 from above the corner member 14 or from outside with the hexagonal nails 23. A positioning member 31 provided on the upper face of each edge of the vertical-panel support member 3 is opposed to the side face of the lower edge of the column 6 to position the lower edge of the column 6. The positioning member 31 is composed of a steel pipe or plywood block having a rectangular profile, and is nailed to the vertical-panel support member 3 with the circular head nails 27. A beam-support member 32 provided on the upper edge of the column 6 is opposed to the lower face of each edge of the beam 7 to support each edge of the beam 7. The beam-support member 32 is composed of a steel pipe or plywood block having a rectangular profile, and is nailed to the column 6 with the circular head nails 27. The positioning member 31 and the beam-support member 32 are installed before the cargo space is established by the front, rear, right and left vertical panels 4 and the top panel 9.

After constructing the transportation container B as described above, a cargo is loaded on the upper face of the mount panel 1 though the partition member 11, the elastic resin material 12 and the floor panel 13. Then, the vertical panels 4, columns 6, beams 7 and top panel 8 are assembled by nailing with the hexagonal head nails 23. When the transportation container B storing the cargo therewithin is transported by a forklift truck, forks of the forklift truck are inserted in between the leg sections of the leg 2. On the other hand, a package according to the transportation container B is opened, the hexagonal head nails 23 nailed to the vertical panels 4 and top panel 8 are pulled off by driving a wrench to detach the vertical panels 4, top panel 8 and others.

As described above, the leg is required to have a certain height to provide a space for allowing the forks of forklift trucks to be inserted thereinto. Generally, the plywood does not have a sufficient thickness for constructing the leg 2. Even if the plywood is laminated to provide a sufficient thickness, the resulting product is inferior in strength and unpractical time and labor is required for the above assembling. Thus, the leg 2 has been made of a metallic material such as a steel pipe.

For the column 6 and beam 7, it is not adequate to form them by laminating the plywood. Specifically, even if nails are hammered to the side face of the laminated plywood, the nails will come off with a minor force. This restricts an efficient hammering direction for allowing the nails to be reliably fixed. Thus, the plywood is not suitable for the column 6 and beam 7 in which nails are hammered to two adjacent surfaces at a right angle.

When the head 2 of the screw-type circular head nail 27 for nailing the leg 2 from above the mount panel 1 has a circular shape and has a thickness less than that of the head 21 of the hexagonal head nail 23 for wrenches, problems caused by the nail head projecting from the upper face of the mount panel 1 are sufficiently eliminated. This may prevent the nail head from hindering an operation for mounting the vertical-panel support members or to assuring containability for cargos.

In the transportation container B, a pallet according to the present invention may be provided by detaching all of components including the right and left vertical panels, which are located above the mount panel 1.

Figure 7:
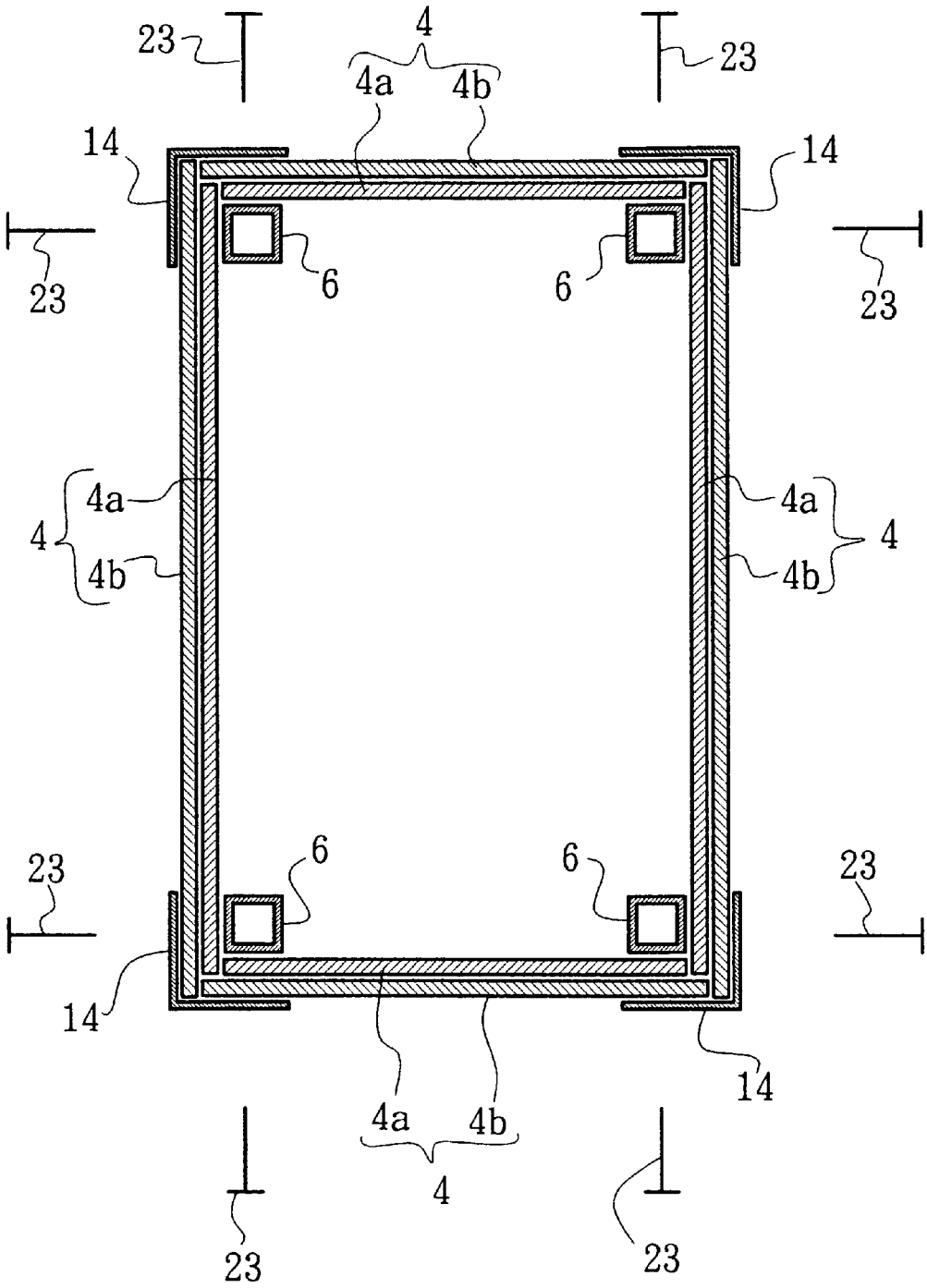
FIG. 7 is a schematic plan sectional view of a modification of a transportation container according to the present invention.

One modification of the transportation container B will now be described. In this modification, each of the vertical panels 4 and the top panel 8 is composed of a plurality (two, in the modification in FIGS. 7 and 8) of solid hardboards 4*a*, 4*b*, 8*a*, 8*b* which are superposed each other. Preferably, these solid hardboards 4*a*, 4*b*, 8*a*, 8*b* are bonded each other with a suitable adhesive. Other structure of this modification is the same as that of the abovementioned embodiment, and bonding and welding are not used as with the abovementioned embodiment. As shown in FIG. 7, in the top plan view of the vertical panels 4, the outer hardboard 4*b* is larger than the inner hardboard 4*a*, and each edge of the outer hardboard 4*b* protrudes outward from a corresponding side of the inner hardboard 4*b*. This provides stepped butt corners formed by adjacent vertical panels 4. In each of the stepped butt corners, the side end face of the inner hardboard 4*a* in one of the vertical panels 4 is opposed to the edge of the inner face of either one of the hardboards 4*a*, 4*b* in another vertical panel. This may effectively prevent water or the like from intruding from outside.

Figure 8:
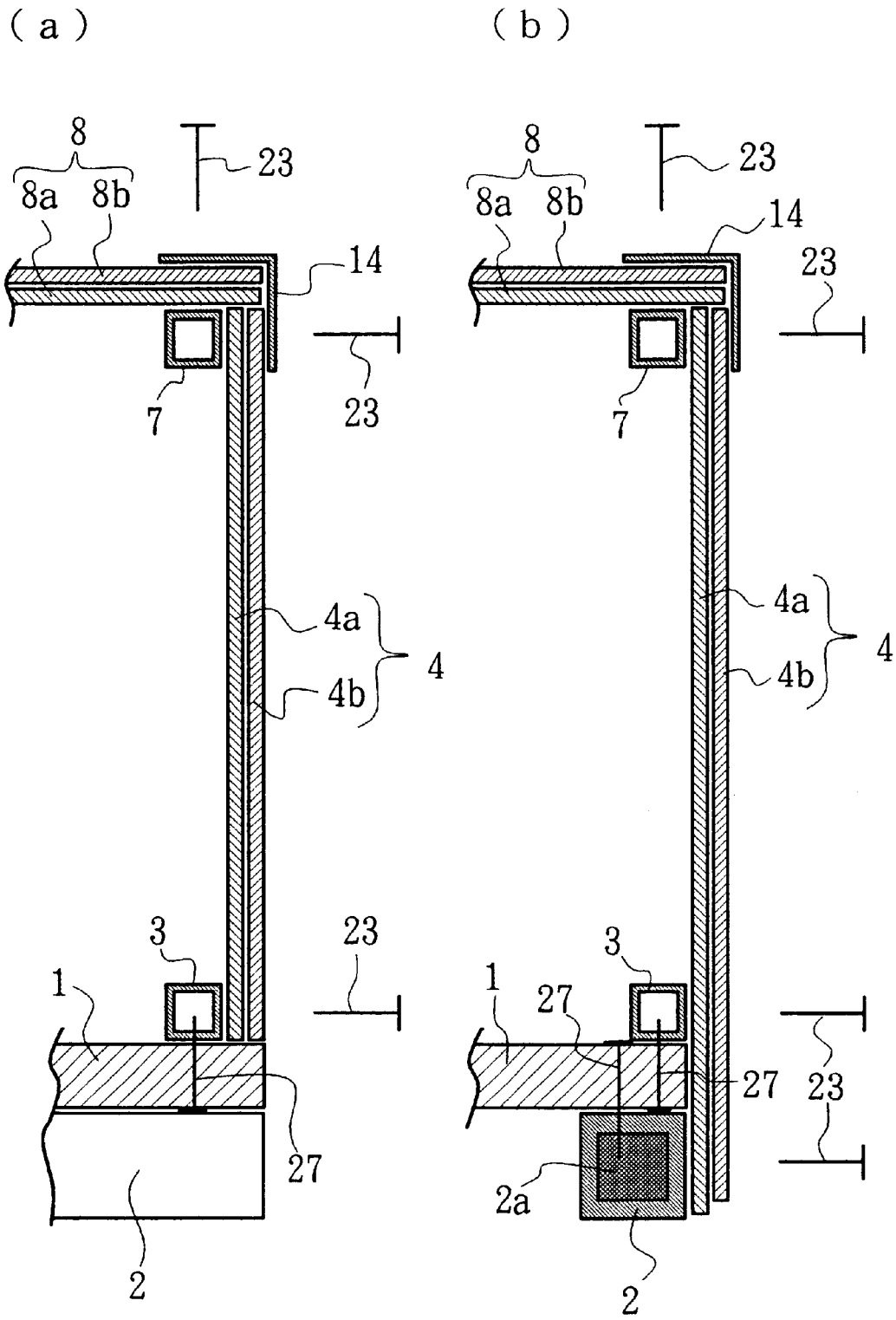
FIG. 8 shows a substantial part of the modification in FIG. 7, wherein FIG. 8(*a*) is a schematic sectional view from lateral side and FIG. 8(*b*) is a schematic sectional view from front side.

Further, as shown in FIG. 8, in each of the vertical panels 4, the upper edge of the inner hardboard 4*a* has a substantially the same height as that of the upper edge of the outer hardboard 4*b*, and each upper end face of the inner and outer hardboards is covered by the top panel 8. This may effectively prevent water or the like from intruding from outside through the upper end faces of the inner and outer hardboards 4*a*, 4*b*. In the front and rear vertical panels 4 shown in FIG. 8(*a*), i.e. the vertical panel 4 having an lower edge nailed to the vertical-panel support member 3, the lower edge of the inner hardboard 4*a* has substantially the same height as that of the lower edge of the outer hardboard 4*b*, and each lower end face of the inner and outer hardboards 4*a*, 4*b* is opposed to the mount panel 1.

In the right and left vertical panels 4 shown in FIG. 8(*a*), i.e. the vertical panel 4 having an lower edge nailed to the vertical-panel support member 3 and the leg 2, the lower edge of the outer hardboard 4*b* has a height higher than the lower edge of the inner hardboard 4*a*. This may prevent a certain object from being caught on the inner face of the lower edge of the outer hardboard 4*b* and being undesirably torn. Further, as shown in FIG. 8, in the top panel, the inner and outer hardboards 8*a*, 8*b* are formed substantially in the same size.

For a second modification, in each of the vertical panels 4, the upper edge of the outer hardboard 4*b* is positioned lower than the upper edge of the inner hardboard 4*a*. Other structure is the same as that of the abovementioned modification. This allows water or the like intruding in each upper end face of the vertical panels 4 to be discharged outside without intruding inside. Thus, the transportation container B may be preserved from the intrusion of water or the like.

While he present invention has been explained in detail in conjunction with the specific embodiment, various modifications and variations may be apparently made without departing from the spirit of scope of the present invention. Thus, it is not intended that the invention be limited to such an embodiment, except as indicated by the appended claims. For example, the following modifications are contemplated.

(1) A bottom panel or supporting leg made of plywood or metal pipe may be provided to connect different positions of the lower face of the leg, for example, by covering over the lower faces of the plurality of leg sections to bridge therebetween.

(2) While the mount panel 1 is composed of a single panel in the above embodiment, it may be formed by combining a plurality of members.

(3) As to each component of the transportation container and pallet, any size may be appropriately selected.

(4) As long as the leg is mounted directly or indirectly on the lower face of the mount panel 1, any arrangement or number may be appropriately selected. However, it is preferable that the leg is provided on the lower face and at least four corners of the mount panel 1.

(5) While the leg 2, vertical-panel support member 3, column 6, beam 7 and partition member 11 is made of a steel pipe in the above embodiment, any metal pipe made of another material (for example, aluminum) may be used. However, a desirable material is steel. Otherwise, a paper pipe may be used. The vertical-panel support member 3 may be formed of another materials (for example, hardboard) other than those of the above embodiment. However, a desirable material is a metal pipe (6) While each component is essentially nailed, the kind of the screw-type nails may be appropriately selected. For example, the hexagonal head nail 23, circular head nail 27 or another kinds of screw-type nails may be selectablly used. However, in order to facilitate the operation for opening packages or to reduce the damage of the transportation container, it is desirable to nail the vertical panels with the hexagonal head nails 23 capable of being detached with wrenches. Other suitable fastening devices may be apparently used, except as indicated by the appended claims.

(7) The partition member 11, elastic resin material 12 or the floor panel 13 may be omitted. In this case, a cargo, such as articles, may be placed directly on the mount panel 1.

(8) The right and left vertical panels 4 may be constructed in substantially the same mounting structure as the front and rear vertical panels 4. Specifically, each lower edge of right and left vertical panels 4 may not be extended to the leg 2 but to the vertical-panel support member 3.

(9) While the leg resin material 2*a* is inserted into the space of the leg in the above embodiment, it may be formed by charging a resin material into the space. However, the inserted leg resin material 2*a* is advantageous to allow the leg 2 and the leg resin material 2*a* to be readily separated in a scrapping operation.

(10) The pallet and transportation container may be assembled by using screw clamping or bolting instead of nailing.

(11) The number of the hardboards forming the vertical panel 4 and top panel 8 may be appropriately selected. That is, one or plurality of hardboards may be selectively used. Further, the vertical panel 4 and top panel 8 may be made of plywood.

What is claimed is:

1. A transportation container comprising:

a substantially rectangular mount panel made of plywood or hardboard;

a metal pipe leg having a substantially rectangular profile, said leg disposed under said mount panel, said leg including right and left sections each along corresponding one of the right and left sides of said mount panel with placing each side face of said right and left sections on substantially the same plane as that of corresponding one of the end faces of said mount panel;

front and rear vertical-panel support members, each of which is mounted on the upper face of said mount panel and disposed along corresponding one of front and rear sides of said mount panel with keeping a given distance from corresponding one of the end faces of said mount panel;

right and left vertical-panel support members, each of which is mounted on the upper face of said mount panel and disposed along corresponding one of the right and left sides of said mount panel with placing each side face of said right and left vertical-panel support members on substantially the same plane as that of corresponding one of the end faces of said mount panel;

front and rear vertical panels, each of which is made of plywood or solid hardboard and has a lower edge mounted on a mounting face in the outer side face of corresponding one of said front and rear vertical-panel support members by means of either one of nailing, screw clamping and bolting from outside;

right and left vertical panels, each of which is made of plywood or solid hardboard and has a lower edge mounted on said leg from outside by means of either one of nailing, screw clamping and bolting and mounted on a mounting face in the outer side face of corresponding one of said right and left vertical-panel support members by means of either one of nailing, screw clamping and bolting from outside;

a beam made of a metal pipe or paper pipe, said beam disposed along the upper side of each inner face of the vertical panels;

a substantially rectangular top panel made of plywood or solid hardboard, said top panel supportedly positioned on the upper end face of said beam; and a column made of a metal pipe or paper pipe, said column disposed on the inside of each butt corner formed by adjacent vertical panels and extending vertically, wherein said mount panel, said front, rear, right and left vertical panels and said top panel define an interior space serving as a cargo space, said vertical-panel support members being made of either one of a metal pipe, paper pipe and plywood, and said column being mounted onto each of said vertical panels from the outside of said vertical panels by means of either one of nailing, screw clamping and bolting without nailing, screw clamping or bolting to said vertical-panel support members and said beam.

2. A transportation container comprising:

a substantially rectangular mount panel made of plywood or hardboard;

a metal pipe leg having a substantially rectangular profile, said leg disposed under said mount panel, said leg including light and left sections each along corresponding one of the right and left sides of said mount panel;

front, rear, right and left vertical-panel support members, each of which is mounted on the upper face of said mount panel and disposed along a corresponding side of the mount panel;

front, rear, right and left vertical panels, each of which is made of plywood or solid hardboard and mounted onto a mounting face in a corresponding outer side face of said support members by means of either one of nailing, screw clamping or bolting from outside;

a beam made of a metal pipe or paper pipe, said beam disposed along the upper side of each inner face of said vertical panels;

a substantially rectangular top panel made of plywood or solid hardboard, said top panel supportedly positioned on the upper end face of said beam;

a column made of a metal pipe or paper pipe, said column disposed on the inside of each butt corner formed by adjacent vertical panels and extending vertically;

a vertical corner member made of solid hardboard, said vertical corner member disposed on the outside of each butt corner formed by adjacent vertical panels and extending vertically so as to cover the outer face of both edges of said adjacent vertical panels;

a horizontal corner member made of solid hardboard, said horizontal corner member disposed on the outside of each butt corner formed by said top panel and said vertical panels and extend horizontally so as to cover the outer face of both edges of said top panel and said vertical panels, wherein said mount panel, said front, rear, right and left vertical panels and said top panel define an interior space serving as a cargo space, said vertical-panel support members being made of either one of a metal pipe, paper pipe and plywood, said column being mounted onto said vertical panel from the outside of said vertical corner member by means of either one of nailing, screw clamping and bolting without nailing, screw clamping or bolting to said vertical-panel support member and said beam, and said vertical panel and said top panel being mounted onto said beam from the outside of said horizontal corner member by means of either one of nailing, screw clamping and bolting.

3. A transportation container comprising:

a substantially rectangular mount panel made of plywood or hardboard;

a metal pipe leg having a substantially rectangular profile, said leg disposed under said mount panel, said leg including light and left sections each along corresponding one of the right and left sides of said mount panel;

front, rear, right and left vertical-panel support members, each of which is mounted on the upper face of said mount panel and disposed along a corresponding side of said mount panel;

front, rear, right and left vertical panels, each of which is made of plywood or solid hardboard and nailed to a mounting face in a corresponding outer side face of said support member from outside;

a beam made of a metal pipe or paper pipe, said beam nailed to the inner face of said vertical panel from the outside of said vertical panels, said beam disposed along each upper side of said vertical panels;

a substantially rectangular top panel made of plywood or solid hardboard, said top panel supportedly positioned on the upper section of said beam and nailed to said beam from above;

a column made of a metal pipe or paper pipe, said column disposed on each butt corner formed by adjacent vertical panels and extending vertically, wherein said mount panel, said front, rear, right and left vertical panels and said top panel define an interior space serving as a cargo space, all of said mount panel, vertical panels, top panel, leg, vertical-panel support members, beam and column being assembled and fixed by means of nailing with screw-type nails, said vertical-panel support members being made of either one of a metal pipe, paper pipe and plywood, said column being nailed from the outside of said vertical panel without nailing to said vertical-panel support member and said beam, and a part of said screw-type nails hammered to at least one panel in said vertical panels and said top panel having a head formed in hexagon for fitting to a wrench.

4. A transportation container as defined in either one of claim 1, 2 and 3, wherein each of said vertical panels is formed by laminating a plurality of solid hardboards including an outer hardboard and inner hard board, wherein said outer hardboard has side edges each protruding outward from a corresponding side edge of said inner hardboard, and each side edge of said inner hardboard in one of said vertical panels is opposed to the edge of the inner face of either one of said hardboards in another vertical panel.

5. A transportation container as defined in claim 4, wherein said outer hardboard includes;

an upper edge having substantially the same height as the upper edge of said inner hardboard; and an lower edge located higher than the lower edge of said inner hardboard, wherein said upper edge is covered by said top panel.

6. A transportation container as defined in claim 4, wherein said outer hardboard includes;

an upper edge located lower than the upper edge of said inner hardboard; and an lower edge located higher than the lower edge of said inner hardboard, wherein said upper edge is covered by said top panel.

7. A transportation container as defined in either one of claim 1, 2, and 3, which further includes:

a metal pipe center leg having a substantially rectangular profile, said center leg disposed between and substantially in parallel with said right and left leg sections of said leg;

a partition member disposed longitudinally on said mount panel and located between the right and left vertical-panel support members, said partition member positioned substantially right above said center leg, said partition member made of either one of a metal pipe, paper pipe or plywood;

an elastic resin material having a buffering function, elastic resin material provided between said partition member and said right vertical-panel support member and between said partition member and said left vertical-panel support member; and a floor panel made of solid hardboard or plywood, said floor panel covering over said elastic resin material, said floor panel having a central section and edge section supported by said partition member and said vertical-panel support members, respectively.

8. A transportation container as defined in either one of claim 1, 2, and 3, which further includes a connecting member made of metal pipe or plywood and for connecting with different sections of the lower face of said leg.

9. A transportation container as defined in claim 4, which further includes:

a metal pipe center leg having a substantially rectangular profile, said center leg disposed between and substantially in parallel with said right and left leg sections of said leg;

a partition member disposed longitudinally on said mount panel and located between the right and left vertical-panel support members, said partition member positioned substantially right above said center leg, said partition member made of either one of a metal pipe, paper pipe or plywood;

an elastic resin material having a buffering function, elastic resin material provided between said partition member and said right vertical-panel support member and between said partition member and said left vertical-panel support member; and a floor panel made of solid hardboard or plywood, said floor panel covering over said elastic resin material, said floor panel having a central section and edge section supported by said partition member and said vertical-panel support members, respectively.

10. A transportation container as defined in claim 4, which further includes a connecting member made of metal pipe or plywood and for connecting with different sections of the lower face of said leg.

11. A transportation container as defined in claim 5, which further includes:

a metal pipe center leg having a substantially rectangular profile, said center leg disposed between and substantially in parallel with said right and left leg sections of said leg;

a partition member disposed longitudinally on said mount panel and located between the right and left vertical-panel support members, said partition member positioned substantially right above said center leg, said partition member made of either one of a metal pipe, paper pipe or plywood;

an elastic resin material having a buffering function, elastic resin material provided between said partition member and said right vertical-panel support member and between said partition member and said left vertical-panel support member; and a floor panel made of solid hardboard or plywood, said floor panel covering over said elastic resin material, said floor panel having a central section and edge section supported by said partition member and said vertical-panel support members, respectively.

12. A transportation container as defined in claim 5, which further includes a connecting member made of metal pipe or plywood and for connecting with different sections of the lower face of said leg.

13. A transportation container as defined in claim 6, which further includes:

a metal pipe center leg having a substantially rectangular profile, said center leg disposed between and substantially in parallel with said right and left leg sections of said leg;

a partition member disposed longitudinally on said mount panel and located between the right and left vertical-panel support members, said partition member positioned substantially right above said center leg, said partition member made of either one of a metal pipe, paper pipe or plywood;

an elastic resin material having a buffering function, elastic resin material provided between said partition member and said right vertical-panel support member and between said partition member and said left vertical-panel support member; and a floor panel made of solid hardboard or plywood, said floor panel covering over said elastic resin material, said floor panel having a central section and edge section supported by said partition member and said vertical-panel support members, respectively.

14. A transportation container as defined in claim 6, which further includes a connecting member made of metal pipe or plywood and for connecting with different sections of the lower face of said leg.

* * * * *